US006112705A

United States Patent [19]

Nakayama et al.

[11] Patent Number: 6,112,705

[45] Date of Patent: Sep. 5, 2000

[54] WATER INJECTION AMOUNT CONTROL SYSTEM FOR FUEL AND WATER INJECTION ENGINE

[75] Inventors: Shinji Nakayama, Yokohama; Koji Mori, Kawasaki; Takazou Hakozaki, Yokohama; Akira Suzuki, Urawa, all of Japan

[73] Assignee: Mitsubishi Jidosha Kogyo Kabushiki Kaisha, Tokyo, Japan

[21] Appl. No.: 09/233,919

[22] Filed: Jan. 21, 1999

[30] Foreign Application Priority Data

Jan. 21, 1998 [JP] Japan ..... 10-009898
Nov. 4, 1998 [JP] Japan ..... 10-313791

[51] Int. Cl.[7] ..... F02B 47/00

[52] U.S. Cl. ..... 123/25 C; 123/25 N

[58] Field of Search ..... 123/25 C, 25 N, 123/25 M, 25 J, 25 L

[56] References Cited

U.S. PATENT DOCUMENTS

| | | | |
|---|---|---|---|
| 4,311,118 | 1/1982 | Slagle | 123/25 M |
| 4,337,731 | 7/1982 | Lohberg | 123/25 M |
| 5,271,137 | 12/1993 | Shimada et al. . | |
| 5,560,344 | 10/1996 | Chan | 123/25 C |

FOREIGN PATENT DOCUMENTS

| | | |
|---|---|---|
| 311148 | 1/1991 | Japan . |
| 427757 | 1/1992 | Japan . |
| 5164003 | 6/1993 | Japan . |
| 5231247 | 9/1993 | Japan . |
| 8144883 | 6/1996 | Japan . |
| 8226360 | 9/1996 | Japan . |
| 9144606 | 6/1997 | Japan . |

*Primary Examiner*—John Kwon

[57] ABSTRACT

A water injection amount control system for a fuel and water injection engine, comprises running state detecting unit for detecting the running state of the engine; an EGR system for recirculating part of exhaust gas of the engine to a combustion chamber of the engine; EGR system operating state detecting unit for detecting or estimating the operating state of the EGR system; water injection amount regulating unit for regulating an amount of water to be injected to the combustion chamber of the engine; and control unit for controlling the operation of the water injection amount regulating unit: wherein the system is arranged to have water injection amount setting unit for deciding a water injection amount based on information from the running state detecting unit and on the operating state of the EGR system detected by the EGR system operating state detecting unit, so that the control unit controls the operation of the water injection amount regulating unit based on the water injection amount decided by the water injection amount setting unit.

8 Claims, 13 Drawing Sheets

WATER INJECTION AMOUNT/ FUEL INJECTION AMOUNT
(AFTER CORRECTION BY EGR AND BOOST PRESSURE)

BOOST PRESSURE

INCREASE WATER INJECTION AMOUNT WITHOUT INCREASE HC BY ENHANCING BOOST PRESSURE

⇩

POSSIBLE TO REDUCE NOx FURTHER

A: LOW BOOST PRESSURE

B: MIDDLE BOOST PRESSURE

C: HIGH BOOST PRESSURE

INFLUENCE OF BOOST PRESSURE AND WATER INJECTION AMOUNT ON EXHAUST GAS

RELATIONSHIP BETWEEN BOOST PRESSURE AND LIMITED WATER INJECTION AMOUNT

WATER INJECTION AMOUNT CONTROL SYSTEM FOR FUEL AND WATER INJECTION ENGINE

BACKGROUND OF THE INVENTION

1. Field of the Invention

The present invention relates to a water injection amount control system for a fuel and water injection engine applied to the engine arranged to inject two fluids of fuel and water to a combustion chamber.

2. Description of Related Art

Hitherto, various technologies for reducing the discharge of NOx by lowering combustion temperature by injecting water together with fuel into a combustion chamber of an engine have been proposed. For example, Japanese Unexamined Patent Publication No. Hei. 8-226360 has disclosed a fuel and water stratified injection system for injecting in the order of fuel, water, and fuel in stratification from one and same injection nozzle.

According to such fuel and water stratified injection system, water is supplied to one and same injection nozzle in advance during the interval period between injections so that fuel, water and fuel are geometrically stratified in this order and the water and fuel are injected to a cylinder in stratification in this order in one time of injection. It then allows flame temperature to be lowered and the emission of NOx, PM (particulate matter) and others to be reduced.

FIG. 15 is a schematic diagram showing the structure of an engine (fuel and water injection engine) equipped with the fuel and water stratified injection system which has been proposed since the past.

As shown in FIG. 15, the engine comprises a main body 100 of the engine, a fuel injection pump 101, a water supply pump 102, an ECU (controller) 103, an intake passage 104 and an exhaust passage 105. The ECU 103 decides the rack position Rw2 of the water supply pump 102 based on engine speed Ne obtained from an operating speed of the fuel injection pump 101 and the rack position Rw1 of the fuel injection pump 101.

Meanwhile, beside those described above, an exhaust gas recirculating system (EGR system) has been well known as means for reducing NOx and has been already put into practical use. The EGR system slacks combustion within a cylinder by recirculating part of exhaust gas of an engine to an induction system to lower combustion temperature and to reduce NOx within the exhaust gas of the engine.

Then, Japanese Unexamined Patent Publication No. Hei. 9-144606 has disclosed a technology for reducing NOx without increasing HC and smoke by combining the fuel and water stratified injection system with the EGR system.

According to this technology, NOx is reduced by actuating only the EGR system when the engine load is below a preset value and NOx is reduced by injecting water in addition to the EGR system when the engine load is in the range exceeding the preset value.

By the way, because the more water is injected, the more the combustion degrades within the cylinder, flameout occurs when water is injected too much. Then, the maximum water injection amount has been set so as not to inject water more than this maximum water injection amount before reaching to the limit of causing the flameout in the past. The maximum water injection amount has been defined based only on engine speed and engine load.

Meanwhile, as a result of the further study on the relationship between the EGR system and the injection of water, the inventors et al. of the present application have obtained a finding that the limit of flameout caused by the injection of water rises when the EGR rate (or EGR amount) increases. Accordingly, it is conceivable that the water injection amount and the maximum water injection amount may be raised corresponding to the increase of the EGR rate and that the effect for reducing NOx may be enhanced further by setting as such.

However, because the related art technology described above has defined the maximum water injection amount only by the engine speed and the engine load, it has been unable to set the water injection amount corresponding to the EGR rate and the NOx reducing effect has been limited naturally.

SUMMARY OF THE INVENTION

The present invention has been devised based on such point of view and an object thereof is to provide a water injection amount control system for a fuel and water injection engine arranged to enhance the NOx reducing effect further by the synergy effect of the EGR system and the injection of water.

A water injection amount control system for a fuel and water injection engine described in a first aspect of the present invention comprises running state detecting means for detecting running state of the engine; an EGR system for recirculating part of exhaust gas of the engine to a combustion chamber of the engine; EGR system operating state detecting means for detecting or estimating the operating state of the EGR system; water injection amount regulating means for regulating an amount of water to be injected to the combustion chamber of the engine; water injection amount setting means for setting a water injection amount based on information from the running state detecting means and the EGR system operating state detecting means; and control means for controlling the operation of the water injection amount regulating means based on the water injection amount set by the water injection amount setting means. The system is capable of reducing the discharge of NOx efficiently while preventing flameout and capable of enhancing the NOx reducing effect further by the synergy effect of the EGR system and the injection of water by thus setting the water injection amount corresponding to the operating state of the EGR system.

Further, a water injection amount control system for a fuel and water injection engine described in a second aspect of the present invention comprises running state detecting means for detecting running state of the engine; an EGR system for recirculating part of exhaust gas of the engine to a combustion chamber of the engine; EGR system operating state detecting means for detecting or estimating the operating state of the EGR system; a super-charger for supercharging the engine; boost pressure detecting means for detecting or estimating boost pressure caused by the supercharger; water injection amount regulating means for regulating an amount of water to be injected into the combustion chamber of the engine; water injection amount setting means for setting a water injection amount based on information from the running state detecting means, the EGR system operating state detecting means, and the boost pressure detecting means; and control means for controlling the operation of the water injection amount regulating means based on the water injection amount set by the water injection amount setting means. The system is capable of reducing the discharge of NOx efficiently while preventing flameout by thus setting the water injection amount corresponding to the operating state of the EGR system and the operating state of the super-charger. That is, in addition to the NOx reducing effect brought about by the synergy effect of the EGR system and the injection of water, the system is capable of obtaining the NOx reducing effect further by optimizing the water injection amount based on the boost pressure.

According to another embodiment of the water injection amount control system for the fuel and water injection engine, the system is provided with a fuel and water injection nozzle constructed to inject fuel and water in stratification in order of fuel, water, and fuel from one and same injection port in one time of injection. Combustion temperature within the cylinder may be reduced and the discharge of NOx may be reduced specifically at this time by injecting fuel and water in stratification in the order of fuel, water, and fuel.

The specific nature of the invention, as well as other objects, uses and advantages thereof, will clearly appear from the following description and from the following drawings in which like numerals refer to like parts.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Preferred embodiments of the present invention will be explained below with reference to the drawings.

Figure 1:
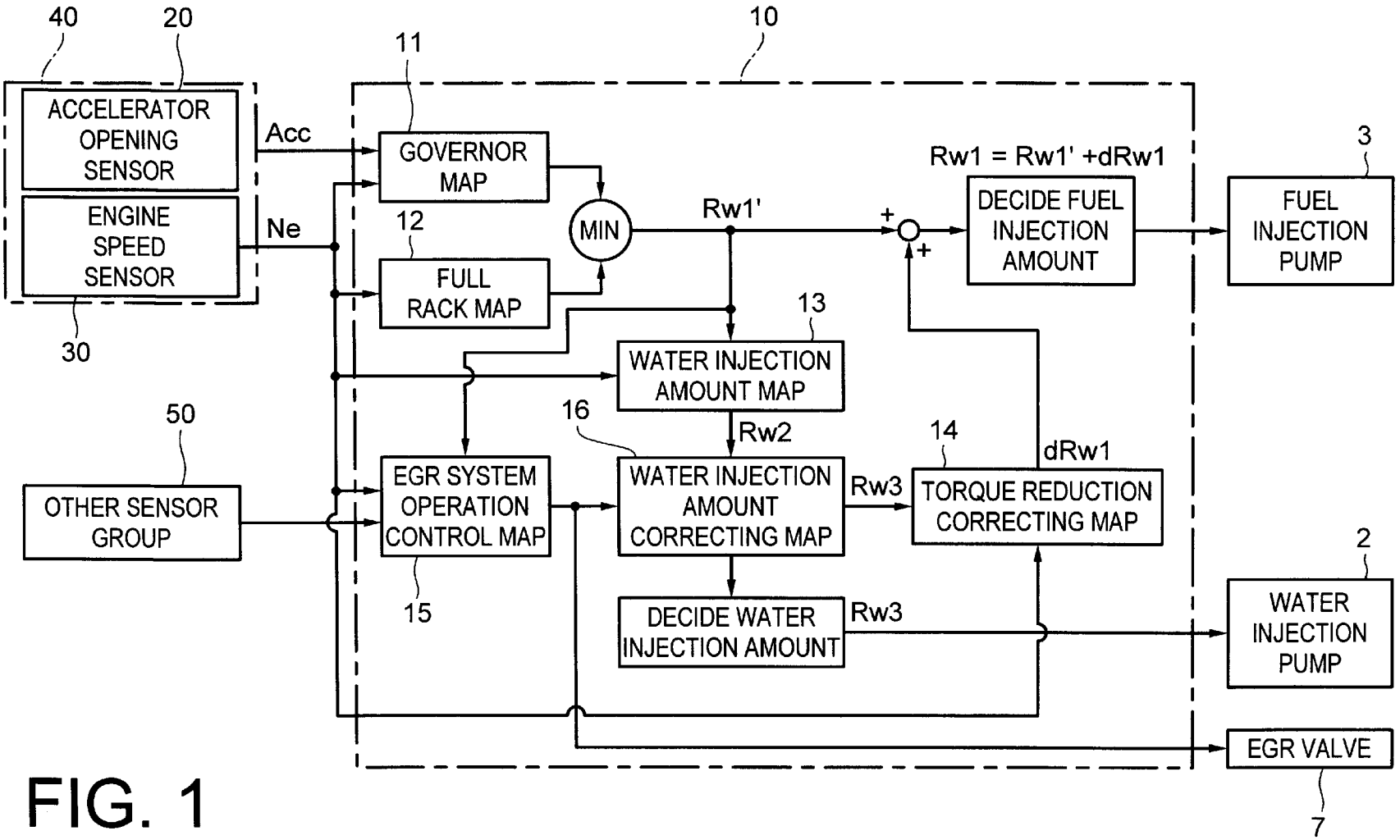
FIG. 1 is a schematic block diagram showing the structure of a water injection amount control system for a fuel and water injection engine, as focusing on main functions thereof, according to a first embodiment of the present invention.
Figure 2A:
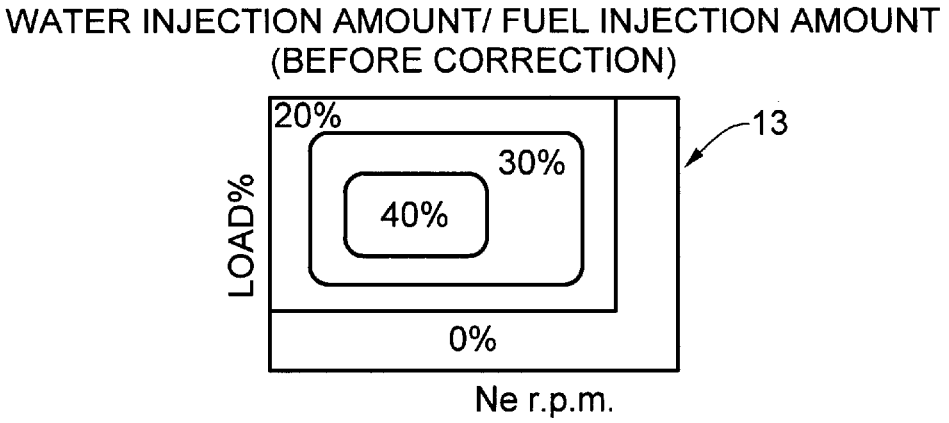
FIGS. 2A through 2C are graphs showing the characteristic of water injection amount, the water injection amount correcting characteristic, and the characteristic of EGR rate in the water injection amount control system for the fuel and water injection engine of the first embodiment.
Figure 2B:
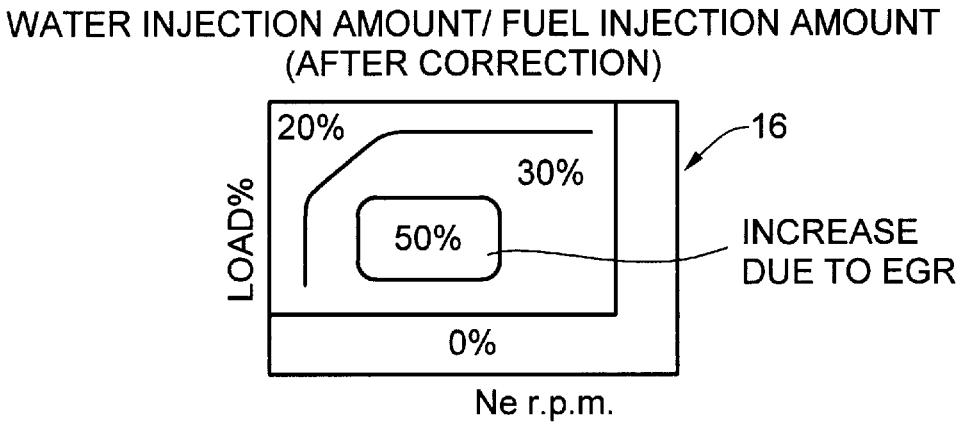
Figure 2C:
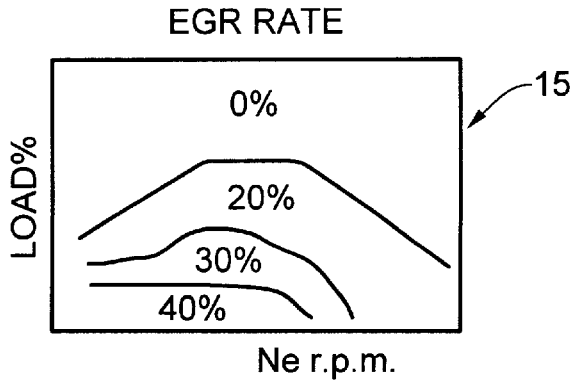
Figure 3:
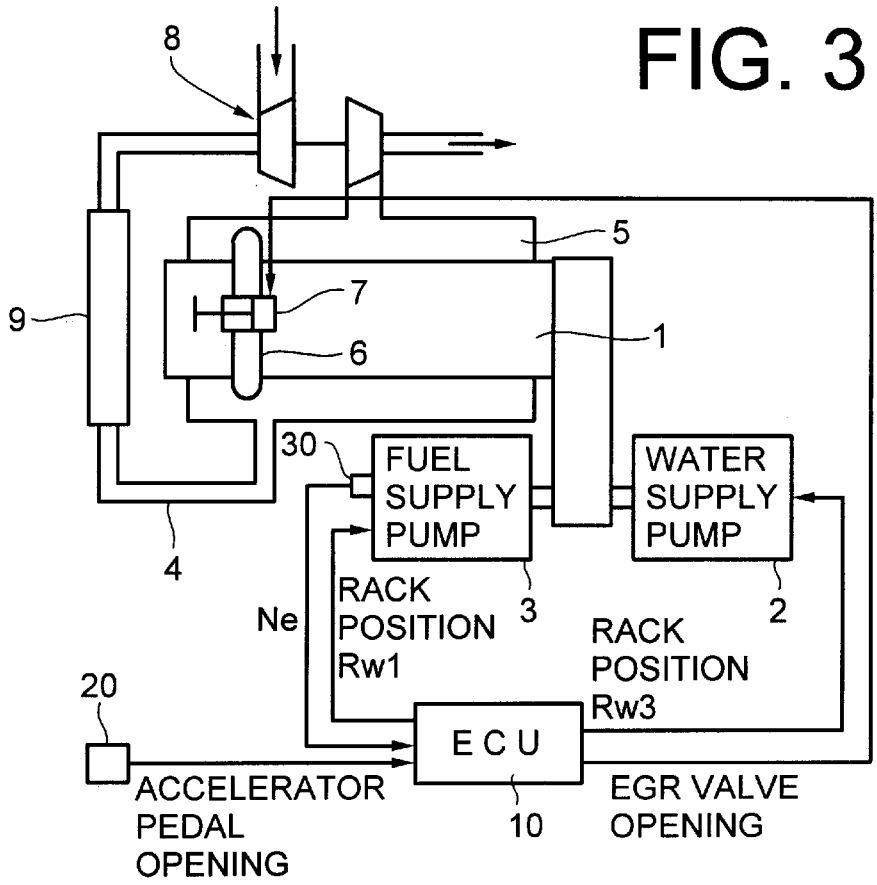
FIG. 3 is a schematic diagram showing the whole structure of the engine to which the water injection amount control system for the fuel and water injection engine of the first embodiment is applied.
Figure 4:
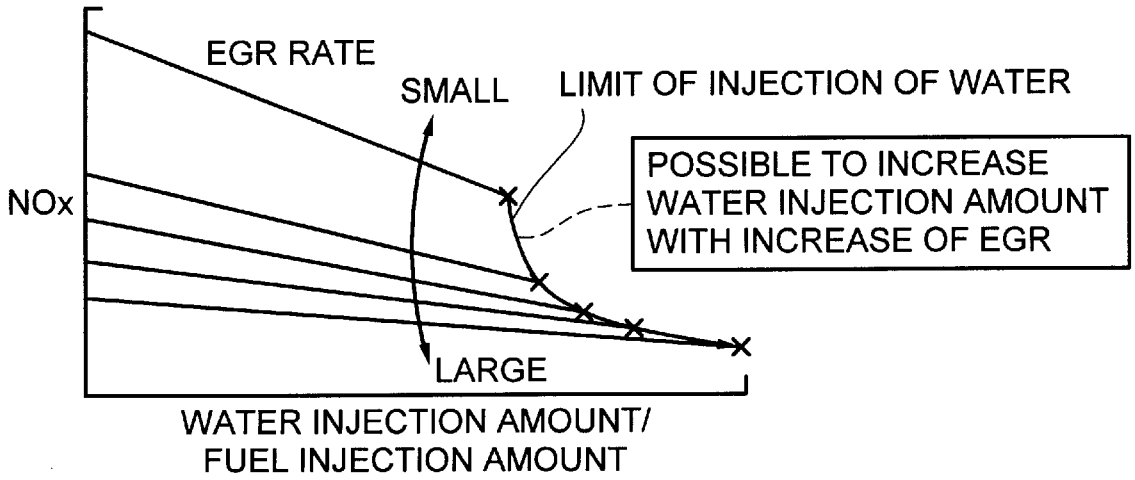
FIG. 4 is a graph for explaining the characteristic of flameout limit of water injection amount in the water injection amount control system for the fuel and water injection engine of the first embodiment.
Figure 5A:
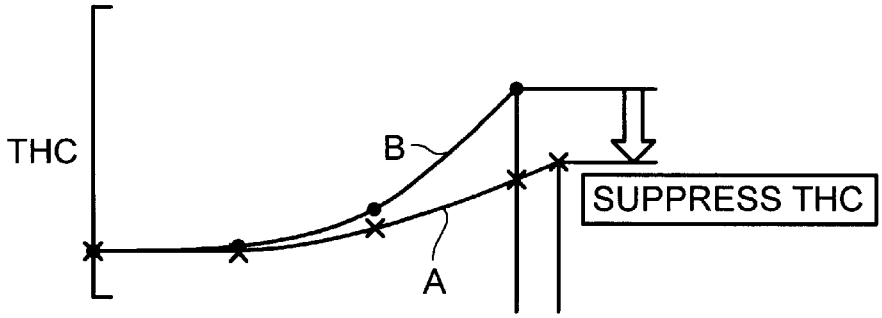
FIGS. 5A through 5C are graphs for explaining the effects in the water injection amount control system for the fuel and water injection engine of the first embodiment.
Figure 5B:
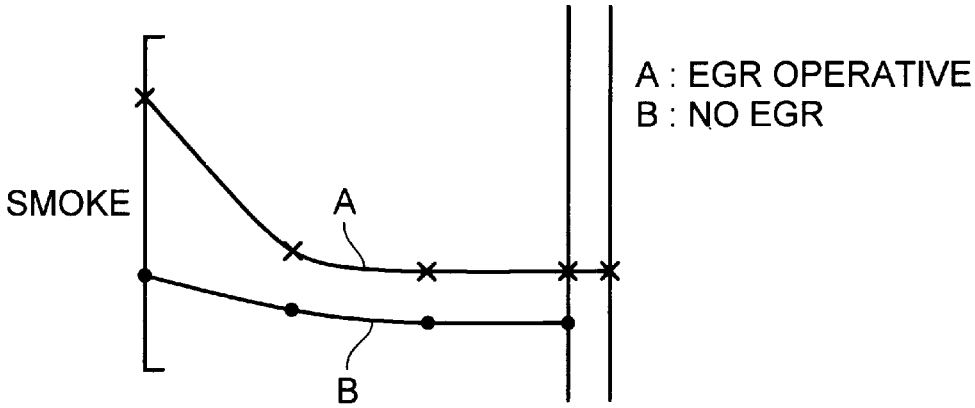
Figure 5C:
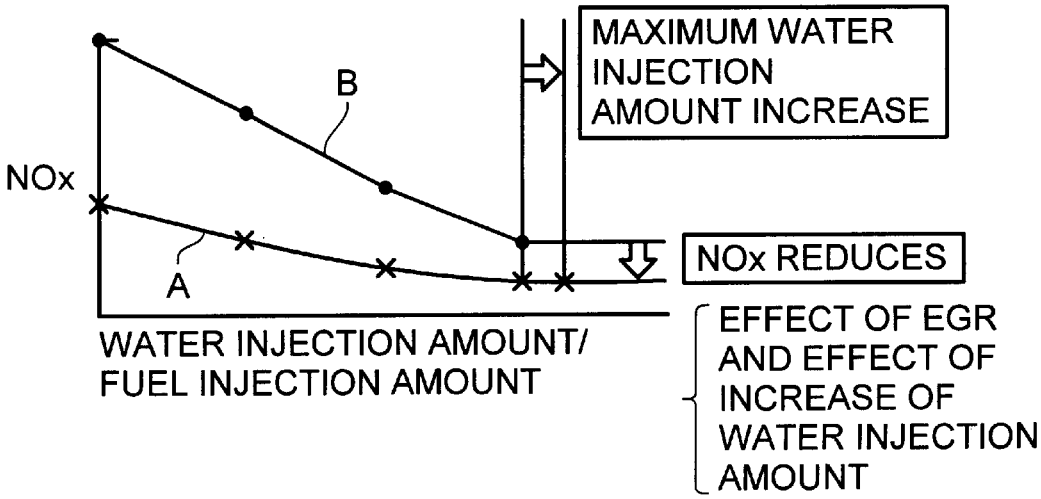
Figure 6:
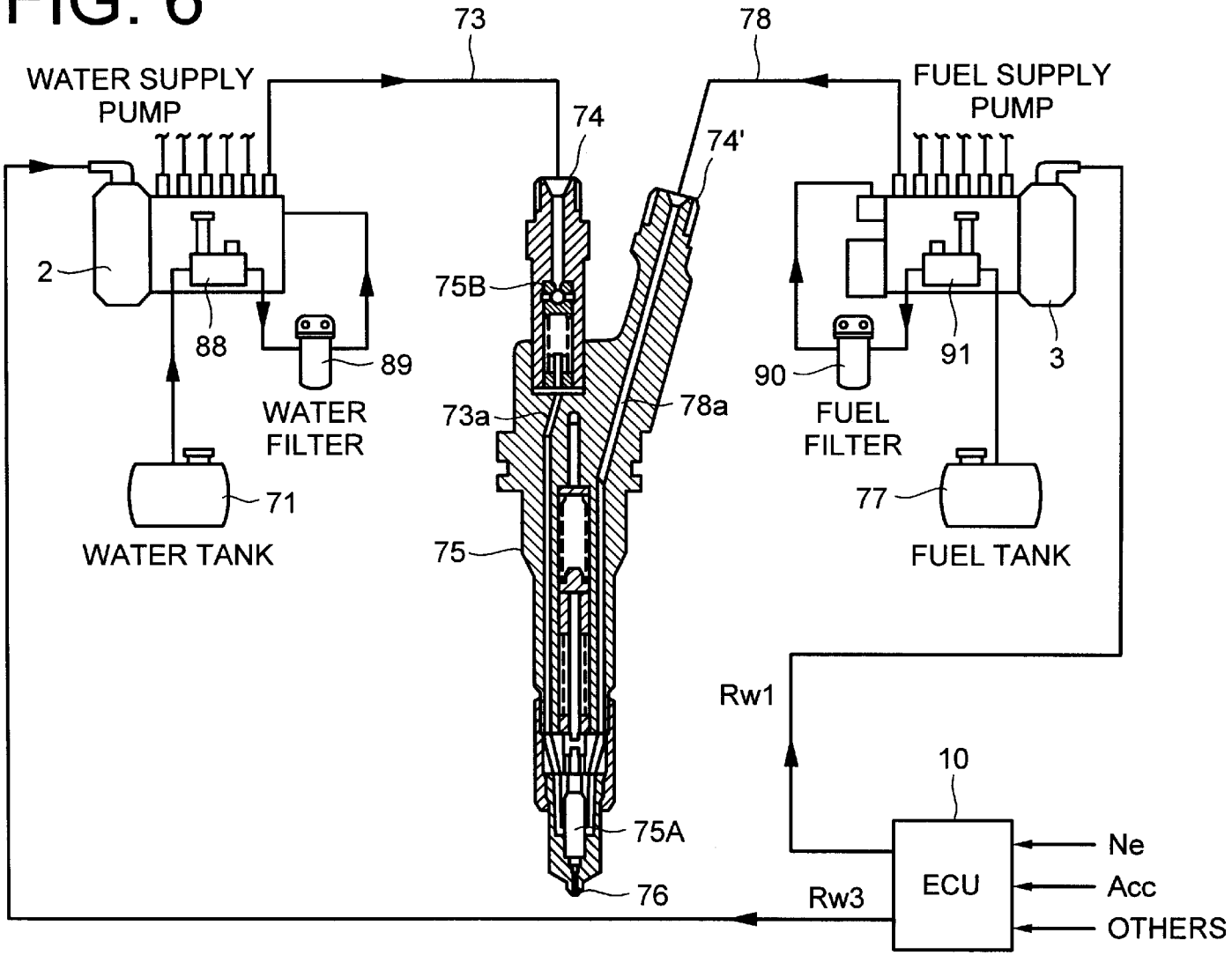
FIG. 6 is a diagram showing the basic structure of a fuel and water supply system of the fuel and water injection engine in the water injection amount control system for the fuel and water injection engine of the first embodiment.
Figure 7:
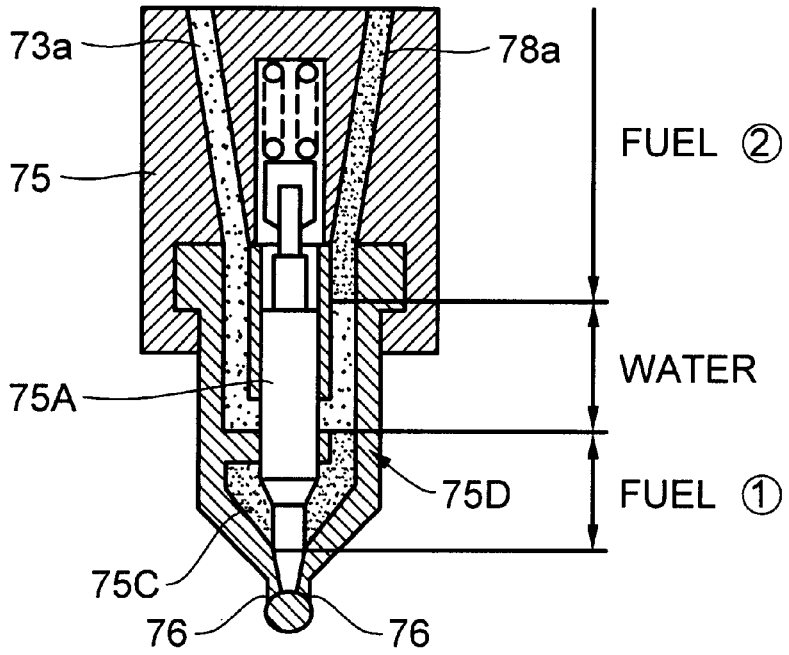
FIG. 7 is an enlarged diagrammatic view of an injection nozzle of the fuel and water injection engine in the water injection amount control system for the fuel and water injection engine of the first embodiment.
Figure 8:
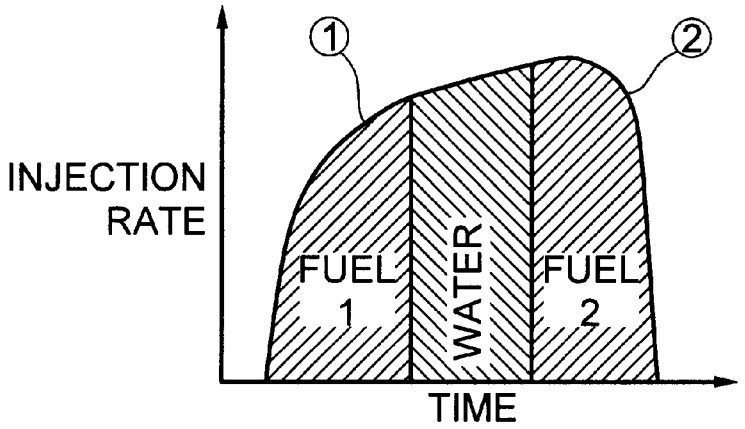
FIG. 8 is a graph for explaining the fuel and water injecting characteristics in the water injection amount control system for the fuel and water injection engine of the first embodiment.
Figure 9:
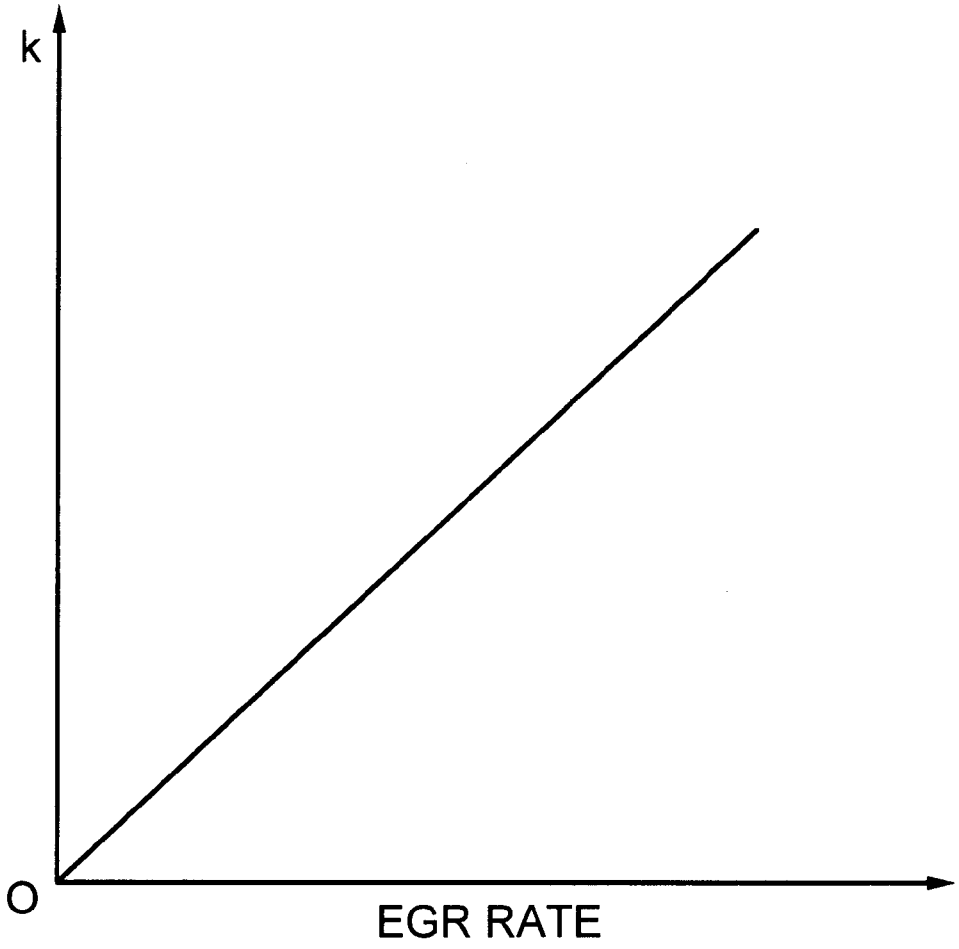
FIG. 9 is a graph for explaining the characteristic of water injection amount correcting factor k based on the EGR rate in a modification of the water injection amount control system for the fuel and water injection engine of the first embodiment.

(a) Description of First Embodiment:

A water injection amount control system for a fuel and water injection engine of the first embodiment of the present invention will be explained at first. FIG. 1 is a schematic block diagram showing the structure of the system by focusing on main functions thereof, FIGS. 2A through 2C are graphs showing the characteristics thereof, FIG. 3 is a schematic diagram showing the entire structure of the engine to which the system of the first embodiment is applied, FIG. 4 is a graph for explaining the characteristic of flameout limit of water injection amount, FIGS. 5A through 5C are graphs for explaining the effects thereof, FIG. 6 is a diagram showing the basic structure of a fuel and water supply system of the fuel and water injection engine, FIG. 7 is a partly enlarged diagrammatic view of an injection nozzle of the fuel and water injection engine, FIG. 8 is a graph for explaining the fuel and water injecting characteristics of the fuel and water injection engine, and FIG. 9 is a graph for explaining the water injection amount correcting characteristic thereof.

The structure of the entire fuel and water injection engine to which the system of the present invention is applied will be explained at first with reference to FIG. 3. As shown in FIG. 3, the fuel and water injection engine comprises a main body 1 of the engine, a water supply pump 2 (water injection amount regulating means), a fuel injection pump 3 (fuel injection amount regulating means), an intake passage 4, an exhaust passage 5, an exhaust gas recirculating passage (EGR passage) 6, an EGR valve 7 for regulating a flow rate of the recirculating exhaust gas which passes through the exhaust gas recirculating passage 6, a turbo-charger 8, an inter-cooler 9, and an ECU (or controller) 10 as control means. An EGR system is composed of the exhaust gas recirculating passage 6 and the EGR valve 7.

The engine 1 is constructed as the fuel and water injection engine in which fuel and water are injected to a combustion chamber from one and same fuel injection nozzle in one time of injection. The operating state of the water supply pump 2 and the fuel injection pump 3 are controlled corresponding to the running state of the engine 1.

Next, the basic structure of the fuel and water supply system in the fuel and water injection engine 1 will be explained briefly with reference to FIGS. 6 through 8. As shown in the figures, the system comprises a water tank 71, a water supply line 73, a water supply port 74, a fuel supply port 74', an injection nozzle 75, a fuel tank 77, a fuel supply line 78, feed pumps 88 and 91, and filters 89 and 90.

After being pressurized to a certain pressure by the water supply pump 2, water stored in the water tank 71 is supplied to the water supply port 74 of the injection nozzle 75 via the water supply line 73. Meanwhile, fuel within the fuel tank 77 is pressurized by the fuel injection pump 3 and is supplied to the fuel supply port 74' of the injection nozzle 75 via the fuel supply line 78.

Thus, water is supplied via the water supply line 73 and fuel is supplied via the fuel supply line 78 to the injection nozzle 75 to be injected from an injection port 76.

The pressure (forcing pressure) for supplying water into the injection nozzle 75 is set to be lower than valve opening pressure of the injection nozzle 75 so that a needle valve 75A of the injection nozzle 75 shown in FIG. 7 is not opened.

By the way, water forced to the injection nozzle 75 pushes open an non-return valve 75B (see FIG. 6) provided at a water passage 73*a* shown in FIG. 7 and reaches to a confluent point 75D of the water passage 73*a* and a fuel passage 78*a* shown in FIG. 7. Then, a part thereof is sent to the side of the fuel passage 78*a*. Here, water tries to push back the fuel existing on the side of the fuel injection pump 3 from the confluent point 75D. When the pressure of water increases more than a preset pressure of a pressure equalizing valve not shown of the fuel injection pump 3, the fuel is pressed back by water and flows backward to the fuel injection pump 3. Thus, the fuel is replaced with the water by that amount.

The fuel existing on the side of the injection hole 76 from the confluent point 75D is not replaced with water. Thereby, water and fuel are disposed geometrically in stratification within the injection nozzle 75 in order of the initial fuel existing between a fuel reservoir 75C at the edge of the nozzle and the confluent point 75D of the water passage 73*a* and the fuel passage 78*a*, the supplied water and the remaining fuel obtained by subtracting the initial fuel injection amount from the total fuel injection amount as shown in FIG. 7.

Then, water and fuel are injected into the cylinder in stratification with the characteristic of injection rate as shown in FIG. 8 by compressing the fuel from the fuel injection pump 3 during the fuel injection period to open the needle valve 75A by the pressure thereof.

The fuel injection amount and the water injection amount are controlled by adjusting the rack position of the fuel injection pump 3 and the water supply pump 2. The rack position of the fuel injection pump 3 and the water supply pump 2 are set by the controller 10 corresponding to the running state of the engine, respectively. It is noted that setting of the fuel injection amount and the water injection amount will be described later.

Next, the main functions of this system will be explained with reference to FIG. 1. As shown in the figure, the system comprises an accelerator pedal opening detecting means (accelerator opening sensor) 20 and an engine speed sensor 30. The accelerator opening sensor 20 and the engine speed sensor 30 compose running state detecting means 40 for detecting the running state of the engine. The system also comprises a group of sensors 50, e.g., other sensors for detecting temperature of cooling water of the engine and temperature of outside air.

These sensors 20, 30, and 50 are all connected to the controller 10. Then, based on respective information such as an accelerator opening angle θ (or accelerator position Acc) and engine speed Ne detected by the accelerator opening sensor 20 and the engine speed sensor 30, respectively, the controller 10 decides the rack position (control parameter value) of the fuel injection pump 3. The controller 10 also decides the rack position of the water supply pump 2 based on the engine speed Ne detected by the engine speed sensor 30 and the rack position of the fuel injection pump 3.

The controller 10 is also provided with an EGR system operation control map 15. The EGR system operation control map 15 is a map for setting a control signal sent to the EGR system (EGR valve 7).

The EGR system operation control map 15 is memorized as a map as shown in FIG. 2C, for example, to allow the optimum EGR rate (target EGR rate) to be set basically based on the information from the engine speed sensor 30 and the engine load. Then, the control signal is outputted to the EGR valve 7 to attain the target EGR rate.

It is noted that the rack position Rw1' (described later), as the basic fuel injection amount, is used as the engine load described above. That is, the target EGR rate is set based on the engine speed and the rack position Rw1' in the present embodiment.

Because the operation of the EGR system is controlled based on the control signal set by the EGR system operation control map 15, the EGR system operation control map 15 has a function as EGR operating state detecting means for detecting or estimating the operating state of the EGR system.

It is noted that although the target EGR rate is set by the EGR system operation control map 15 by adding also information from the group of other sensors 50, a detailed explanation of the control of the EGR system will be omitted here because the control of the EGR system itself in the present embodiment is a known technology. It is also noted that means for calculating the opening angle of the EGR valve 7 by computing the optimum EGR rate based on the information from the respective sensors 30 and 50 and on the rack position Rw1' may be provided instead of the EGR system operation control map 15.

By the way, as shown in FIG. 1, the controller (ECU) 10 is provided also with a governor map 11, a full rack map 12, a water injection amount map 13, a torque reduction correcting map 14 and a water injection amount correcting map 16.

The governor map 11 and the full rack map 12 are maps for setting the rack position Rw1' for setting the basic injection amount of fuel (basic fuel injection amount). Here, the basic fuel injection amount is a fuel injection amount supposed to be required when no water is injected and is equivalent to a fuel injection amount set in general engines. The rack position Rw1' is set as follows for example.

At first, the rack position of the fuel injection pump 3 is set temporarily by using the governor map 11 and by taking the accelerator position Acc and the engine speed Ne detected by the accelerator opening sensor 20 and the engine speed sensor 30 as parameters. The maximum rack position of the fuel injection pump 3 is also defined by using the full rack map 12 and by taking the engine speed Ne as a parameter. Then, the smaller one among the rack positions set by these maps 11 and 12 is selected and is set as the basic rack position Rw1'. It is noted that such method for setting the basic fuel injection amount is publicly known.

Next, the water injection amount map 13 will be explained briefly. The water injection amount map 13 is a map for setting a quantity of water supplied to the injection nozzle 75 (see FIG. 6), i.e., for setting the water injection amount. The rack position Rw2 of the water supply pump 2 is set by the water injection amount map 13 by taking the rack position Rw1' of the basic fuel injection amount described above and the information on the engine speed as parameters.

The water injection amount map 13 is memorized as a map as shown in FIG. 2A for example and allows the water injection amount to be set corresponding to the engine speed and the engine load (the rack position Rw1'). Then, when the water injection amount is set by the water injection amount map 13, the rack position Rw2 corresponding to this water injection amount is set. It is noted that the rate (%) of water injection amount to the fuel injection amount, i.e., a water injection rate, is set by the water injection amount map 13. Such rate of water injection amount to the fuel injection amount will be referred simply as the water injection amount hereinafter.

The water injection amount is set at 0% when the engine speed is high and when the load is low in the water injection amount map 13 as shown in FIG. 2A. It is because the discharge of smoke increases and the fuel consumption is worsened relatively with respect to the reduction of NOx when water is injected too much in the range when the engine speed is high. Accordingly, no water is injected in the range where the speed is higher than a predetermined speed.

The water injection amount is set at 0% also in the low load range because it is difficult to inject water in such low load range due to the structure of the injection nozzle 75. That is, when a required fuel injection amount is small and the engine can run fully by an amount of fuel less than the amount of fuel supplied to the fuel reservoir 75C (see FIG. 7) at the edge of the nozzle in the low load range, the injection of fuel ends without injecting water even if a water injection amount is set. Then, the present embodiment is arranged so as not to set the water injection amount when the engine load is less than a predetermined load.

When the rack position Rw2 of the water supply pump 2 is decided once by the water injection amount map 13, the water injection amount (the rack position Rw2) is corrected by the water injection amount correcting map 16 corresponding to the EGR rate set by the EGR system operation control map 15.

The reason why the water injection amount is corrected corresponding to the EGR rate will be explained here at first. FIG. 4 shows the relationship between the water injection amount and the discharge of NOx by taking the EGR rate as a parameter, wherein marks 'X' at the right edge of the respective characteristic lines indicate the maximum water injection amount in the range causing no flameout. It can be seen from FIG. 4 that the higher the EGR rate, the higher the limit of flameout caused by injection of water is and more water can be injected.

It is because the inlet air temperature rises when the EGR rate increases because the rate of exhaust gas (EGR gas) recirculated to the intake passage 4 (see FIG. 3) increases and the ignitability of the fuel injected in the initial period is improved, thus raising the limit of flameout, when fuel and water are injected in stratification in the order of fuel, water, and fuel. Therefore, there is a case when no flameout occurs in the running state in which the EGR rate is high even with the same water injection amount which may cause flameout when the EGR rate is low.

Further, because the more the water injection amount, the greater the NOx reducing effect is, it is desirable to inject water as much as possible within the range that causes no flameout.

However, because the maximum water injection amount has been decided without adding the EGR rate in the past, there has been a large margin to the limit of flameout in the running range in which the EGR rate is large even when the water injection amount is set at the maximum water injection amount.

Then, the present system is arranged to increase the water injection amount by increasingly correcting the rack position Rw2 set by the water injection amount map 13 corresponding to the EGR rate.

Next, the correction of the water injection amount will be explained concretely. A map as shown in FIG. 2B is memorized as the water injection amount correcting map 16. The rack position Rw2 is corrected so that a water injection amount is set at the water injection amount set by the water injection amount correcting map 16.

The water injection amount correcting map 16, shown in FIG. 2B, indicates the water injection amount, which is increasingly corrected corresponding to the EGR rate with respect to the characteristic of the water injection amount map 13 shown in FIG. 2A.

For instance, while the water injection amount is set to be 40% in the range in which the engine speed and the engine load are almost middle in the water injection amount map 13 shown in FIG. 2A, the EGR rate is set at 20 to 30% as shown in FIG. 2C in such running range and the inlet air temperature rises by that much by the effect of the recirculated EGR gas.

Then, the water injection amount in such middle load and middle speed range is changed from 40% to 50% as shown in FIG. 2B. The running range in which the water injection amount is set at 30% is also changed more or less corresponding to the EGR rate in the present embodiment. Further, although the ranges in which the water injection amount is 50% and 30% are shown typically in FIG. 2B, there exists a range of 40% for example between such ranges of 50 and 30%. It is noted that although the water injection amount correcting map 16, shown in FIG. 2B, is provided as a map for setting the water injection amount itself in the first embodiment, it may be provided as a map for setting only the correction amount with respect to the water injection amount set by the water injection amount map 13 shown in FIG. 2A.

Next, the torque reduction correcting map 14 will be explained. The torque reduction correcting map 14 is provided to increasingly correct the basic fuel injection amount (the rack position Rw1') to compensate a decrease of torque caused by the injection of water.

That is, although the fuel and water injection engine in which fuel and water are injected into the combustion chamber by one time of injection, can reduce the discharge of NOx, PM, and others by lowering the flame temperature within the combustion chamber, the fuel amount decreases by an amount replaced by water. Thus, output torque is reduced as compared to the case when only fuel is injected. Then, the fuel injection amount is increasingly corrected corresponding to the water injection amount when water is to be injected.

Here, a rack position correction value dRw1 for correcting the decrease of torque is set by the torque reduction correcting map 14 based on the rack position Rw3 corrected by using the water injection amount correcting map 16 and the information Ne detected by the engine speed sensor 30. In concrete, the fuel correction amount corresponds to the water injection amount, so that the fuel correction amount is increased as the water injection amount increases.

Then, the controller 10 sets the final rack position Rw1 of the fuel injection pump 3 by adding the correction value dRw1, described above, to the rack position Rw1' of the basic fuel injection amount set by the governor map 11 and the full rack map 12 described above. The controller 10 also sets the control signal sent to the fuel injection pump 3 so that the rack position of the fuel injection pump 3 is set at Rw1 to thereby control the operation of the fuel injection pump 3.

The controller 10 also sets the control signal sent to the water supply pump 2 so that the rack position of the water supply pump 2 is set at the rack position Rw3 of the water injection amount set (or corrected) by the water injection amount correcting map 16 to thereby control the operation of the water supply pump 2.

Because the water injection amount control system for the fuel and water injection engine of the first embodiment of the present invention is constructed as described above, the information Acc and Ne detected by the accelerator opening sensor 20 and the engine speed sensor 30 are taken into the ECU (controller) 10 at first and the rack position Rw1' of the fuel injection pump 3 is set by the governor map 11 and the full rack map 12 based on such detected information.

The water injection amount (the rack position Rw2 of the water supply pump 2) is set by the water injection amount map 13 by taking the rack position Rw1' of the fuel injection pump 3 and the engine speed Ne as the parameters.

Meanwhile, the target EGR rate of the EGR system is set by the EGR system operation control map 15 by adding information from the group of other sensors 50 to the information from the engine speed sensor 30 and the opening angle of the EGR valve 7 is controlled to attain this target EGR rate.

Then, based on the EGR rate set by the EGR system operation control map 15, the rack position Rw2 of the water supply pump 2 is corrected by the water injection amount correcting map 16 and the operation of the water supply pump 2 is controlled so that the rack position is set at the corrected rack position Rw3 in the present system.

It is noted that the water injection amount map (see FIG. 2B), corrected by taking the EGR rate into account, is set as the water injection amount correcting map 16 in the first embodiment. In concrete, the corrected water injection amount is set from the map shown in FIG. 2B based on the engine speed and the load in the water injection amount correcting map 16.

Then, the water injection amount is set to increase corresponding to the increase of the EGR rate, for example, in the water injection amount correcting map 16. Thereby, the maximum water injection amount also increases corresponding to the increase of the EGR rate.

Further, the rack position correction value dRw1 for correcting the decrease of torque caused by the injection of water is set by the torque reduction correcting map 14 based on the rack position Rw3 of the water supply pump 2 set by the water injection amount correcting map 16 and the information Ne detected by the engine speed sensor 30.

Then, this correction value dRw1 is added to the rack position Rw1' of the basic fuel injection amount to set the final rack position Rw1 of the fuel injection pump 3 as Rw1'+dRw1. Then, the operation of the fuel injection pump 3 is controlled so that the rack position thereof is set at that rack position.

Then, NOx may be reduced further without increasing the discharge of HC and smoke as shown in FIGS. 5A through 5C by increasing the water injection amount corresponding to the increase of the EGR amount as described above.

All of the horizontal axes of FIGS. 5A through 5C represent the rate of the water injection amount to the fuel injection amount and the vertical axes represent the discharges of HC (THC), smoke, and NOx, respectively. While the both characteristics of the case when the EGR system is not operated (hereinafter referred to as 'no EGR') and the case when the EGR system is operated (hereinafter referred to as 'EGR is operative') are shown in the respective graphs, the characteristic when the EGR rate is held at a predetermined value will be typified when the EGR system is operated as for the characteristic of the case when EGR is operative. Each graph shows the characteristics studied by fixing the fuel injection amount at a predetermined value and by changing the water injection amount.

The maximum water injection amount may be increased in case when the EGR is operative as compared to the case of no EGR as shown in FIGS. 5A through 5C because the inlet air temperature rises, the ignitability of fuel injected in the initial period improves and the limit of flameout rises. (See the difference between the right edge part of the characteristic line A of 'EGR is operative' and the right edge part of the characteristic line B of 'no EGR' shown in each of FIGS. 5A through 5C).

As for the discharge of HC, although HC inclines to increase as the maximum water injection amount increases as shown in FIG. 5A, the discharge of HC may be suppressed considerably as compared to the case of no EGR. It is noted that although the case when an operation of EGR is disadvantageous to the case of no EGR also as for the discharge of smoke, the discharge of smoke may be reduced to the level equal to the case when no water is injected and no EGR is operated by injecting water.

Meanwhile, because the more the water injection amount, the more NOx drops as shown in FIG. 5C, it is effective to increase the water injection amount to reduce NOx.

Accordingly, the NOx reducing effect brought about by the injection of water may be enhanced further without causing flameout by increasing the water injection amount corresponding to the increase of the EGR rate during when the EGR system is operative and the considerable reduction of NOx may be realized while suppressing the increase of the discharge of HC and smoke by the synergy effect with the NOx reducing effect brought about by the EGR system itself.

As described above in detail, the water injection amount control system for the fuel and water injection engine of the first embodiment of the present invention increasingly corrects the water injection amount corresponding to the increase of the EGR rate, so that it is capable of setting the optimum water injection amount corresponding to the EGR rate and is capable of reducing the discharge of NOx efficiently while preventing flameout.

That is, although it may be considered that the water injection amount becomes excessive and flameout occurs in the running range in which the EGR rate is low by increasing the water injection amount simply to reduce the discharge of NOx, the inventive system has an advantage that it can suppress the water injection amount and prevent flameout in the running range where the EGR rate is low and can reduce the discharge of NOx efficiently by the synergy effect of the NOx reducing effect of the EGR system itself and that brought about by the increase of the water injection amount because the water injection amount is increased in the running range where the EGR rate is high and where the inlet air temperature rises and the limit of flameout rises by the EGR.

Next, a modification of the first embodiment of the present invention will be explained. It is noted that only the method for correcting the water injection amount in the water injection amount correcting map 16 is different in this modification and others are almost the same with those in the first embodiment. Accordingly, only the method for correcting the water injection amount in the water injection amount correcting map 16 will be explained below and an explanation of the others will be omitted.

According to this modification, when the rack position Rw2 of the water supply pump 2 is decided by the water injection amount map 13, the control signal from the EGR system operation control map 15 is taken into the water injection amount correcting map 16 to set a correction factor k ($k \geqq 0$) for correcting the water injection amount based on the EGR rate set by the EGR system operation control map 15.

Here, the correction factor k is set to have the characteristic as shown in FIG. 9 for example, i.e., so that the greater the EGR rate, the greater the correction factor k is. It is noted that although the correction factor k is set to increase with a fixed rate with the increase of the EGR rate, the characteristic of the correction factor k is not limited to such one and may be set to have other characteristics such as a quadratic functional characteristic as long as it is set to have the characteristic in which the correction factor k increases with the increase of the EGR rate.

It is noted that no correction of water injection amount is set by EGR in the running range in which no water is injected in the low load domain as described in the first embodiment.

Then, when the correction factor k is set by the water injection amount correcting map 16 as shown in FIG. 9, the rack position Rw2 set by the water injection amount map 13 is corrected by the following expression.

That is, the rack position Rw3 of the water supply pump 2 after the correction is set as Rw3=(1+k).Rw2.

That is, 1 is added to the factors k, and the resultant value is multiplied with the rack position Rw2 to output as the rack position of the water supply pump 2.

Accordingly, when the correction factor k is set at 0.2, a value obtained by multiplying the rack position Rw2, set by the water injection amount map 13, by 1.2 is outputted as the rack position Rw3 of the water supply pump 2. It is noted that the correction factor setting range and the numerical expression for correcting the rack position are not limited to those described above.

The same effect with the first embodiment may be obtained even when the water injection amount is corrected as described in this modification.

Figure 10:
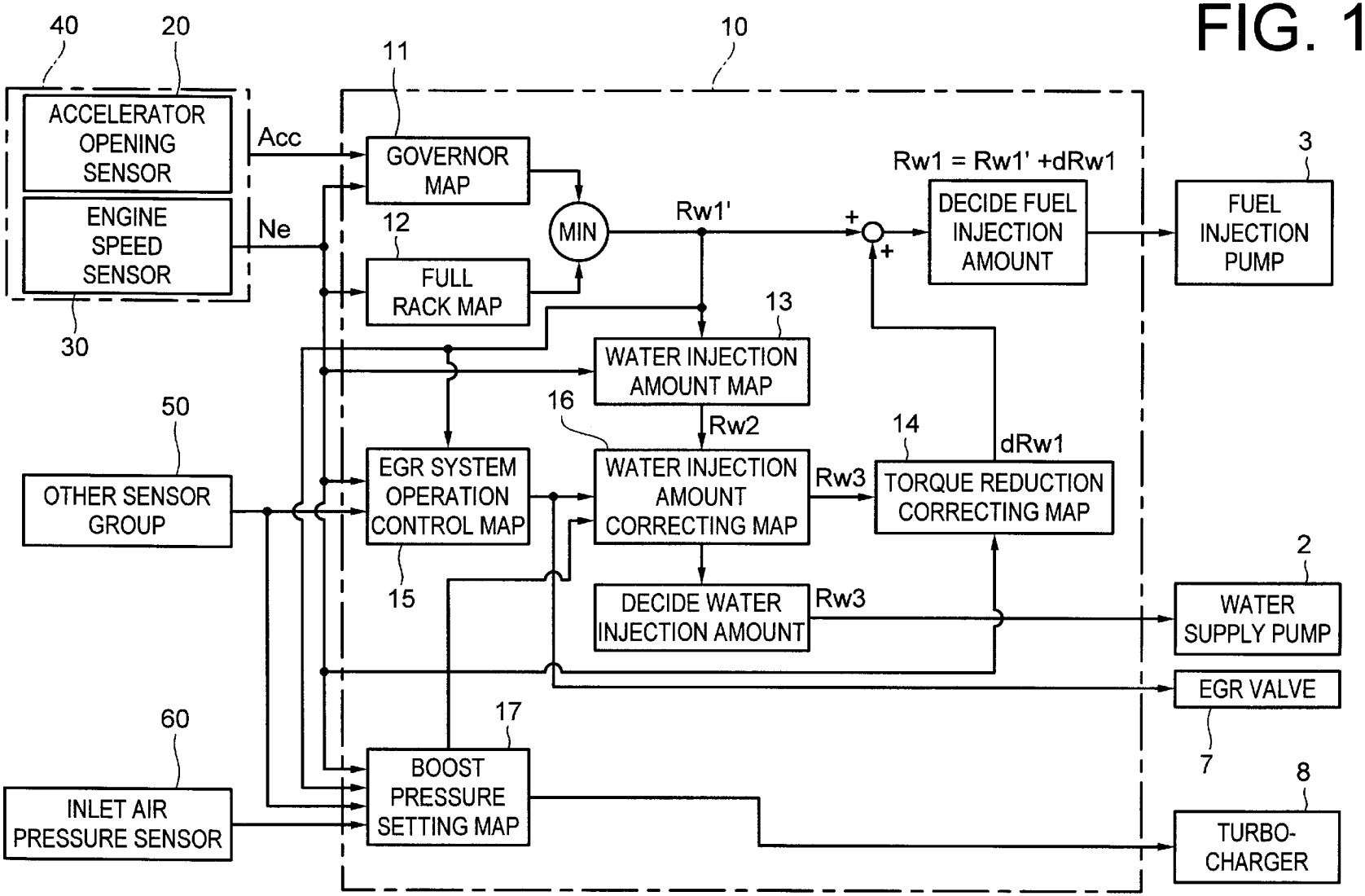
FIG. 10 is a schematic block diagram showing the structure of a water injection amount control system for a fuel and water injection engine, as focusing on main functions thereof, according to a second embodiment of the present invention.
Figure 12:
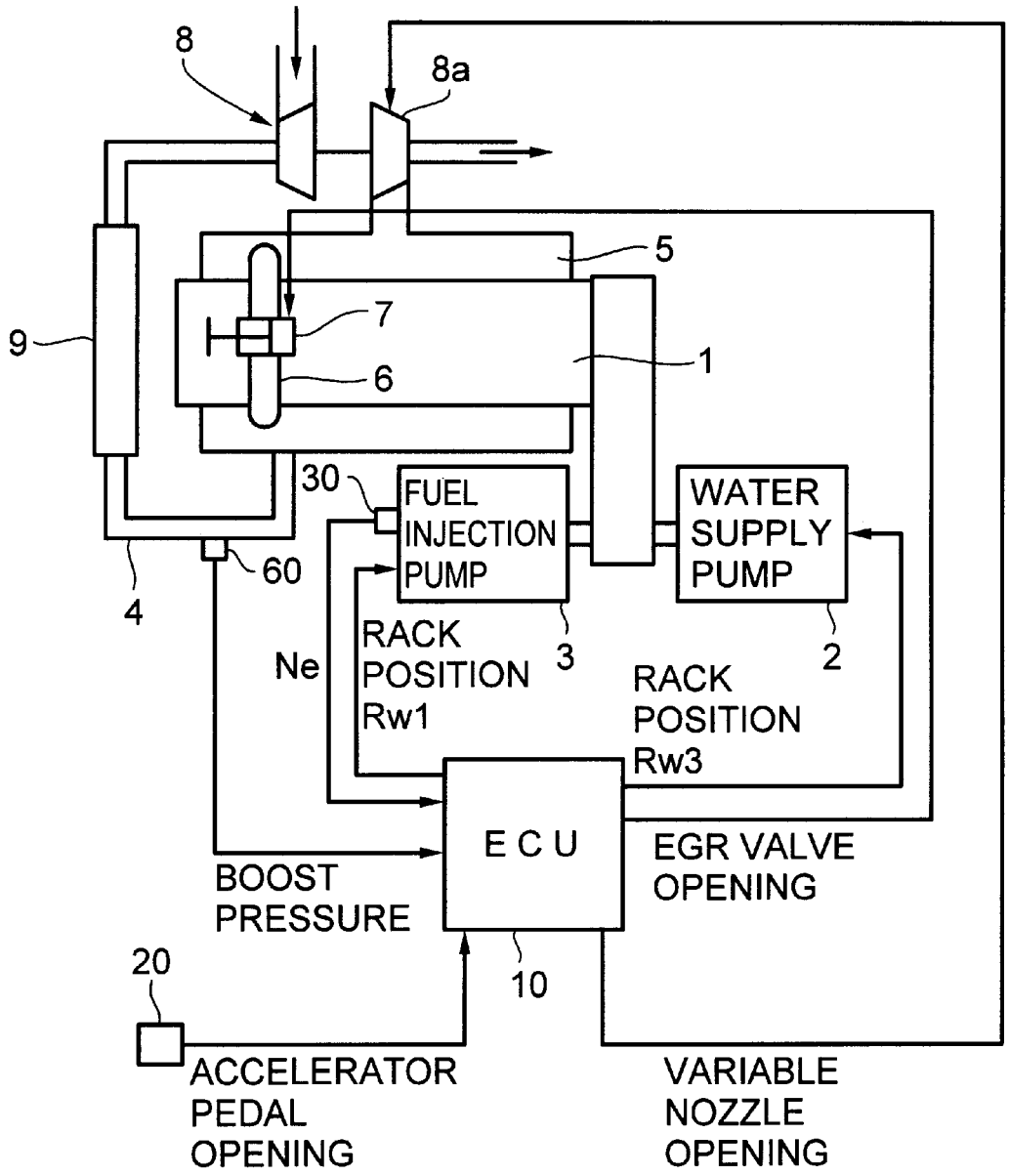
FIG. 12 is a schematic diagram showing the whole structure of an engine to which the water injection amount control system for the fuel and water injection engine of the second embodiment is applied.
Figure 13A:
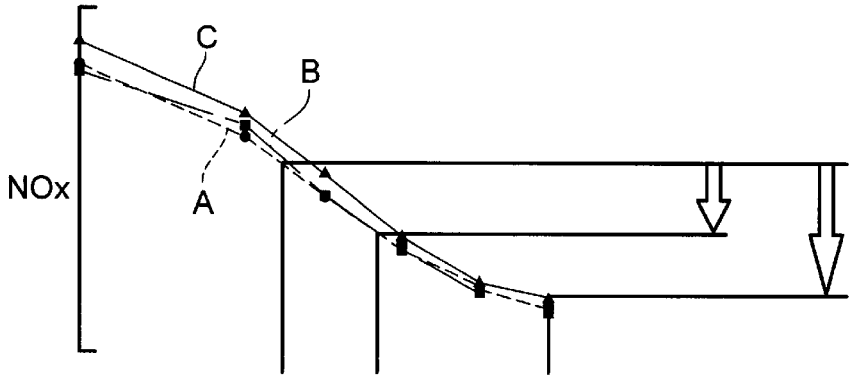
FIGS. 13A through 13C are graphs for explaining the effects in the water injection amount control system for the fuel and water injection engine of the second embodiment.
Figure 13B:
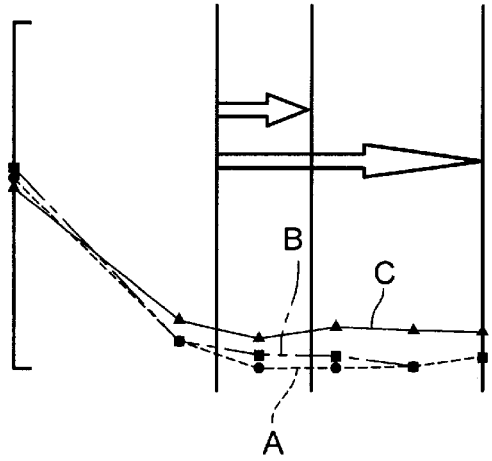
Figure 13C:
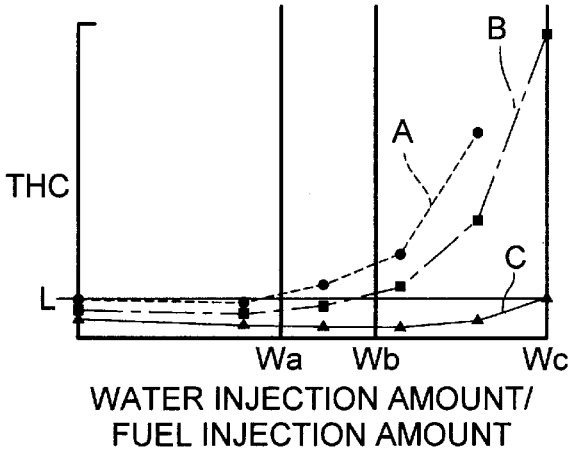
Figure 14:
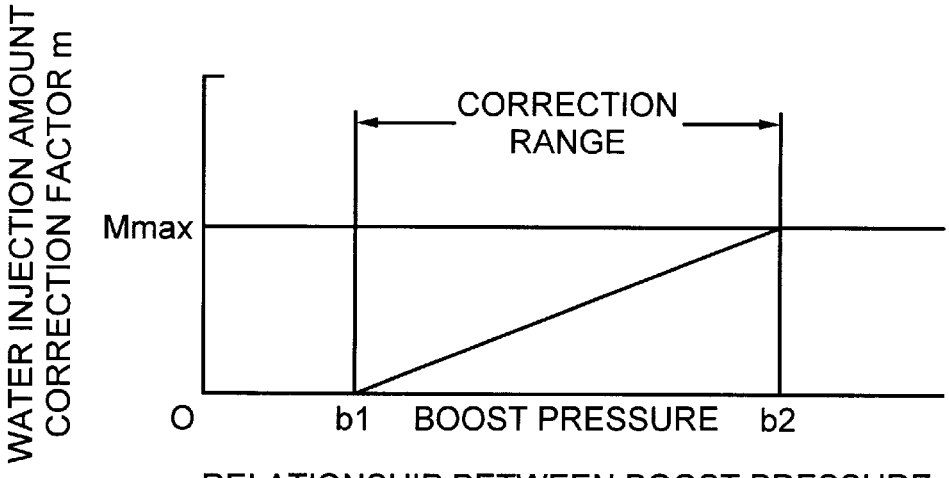
FIG. 14 is a graph for explaining the characteristic of water injection amount correcting factor m based on the boost pressure in a modification of the water injection amount control system for the fuel and water injection engine of the second embodiment.
Figure 15:
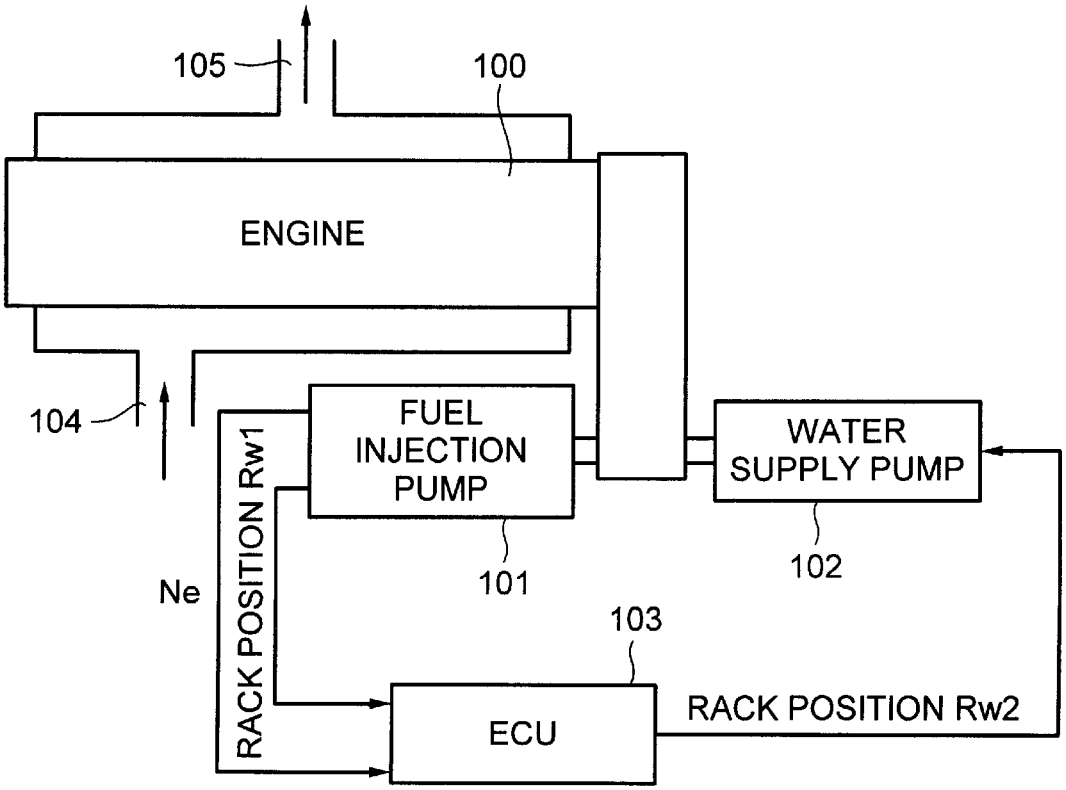
FIG. 15 CONVENTIONAL ART
FIG. 15 is a schematic diagram showing the structure of an engine fitted with a fuel and water stratified injection system which has been proposed since the past.

(b) Description of Second Embodiment:

The water injection amount control system for the fuel and water injection engine, as the second embodiment of the present invention, will be explained below. FIG. 10 is a schematic block diagram showing the structure thereof by focusing on the main functions thereof, FIGS. 11A through 11E are graphs showing the characteristics of the fuel and water injection engine, FIG. 12 is a schematic diagram showing the entire structure of the engine to which the system of the second embodiment is applied; FIGS. 13A through 13C are graphs for explaining the effects thereof; and FIG. 14 is a graph for explaining a modification thereof.

By the way, although the water injection amount has been corrected corresponding to the EGR rate in the first embodiment described above, the water injection amount is corrected by taking the boost pressure of the turbo-charger 8 as a parameter in addition to the EGR rate in the second embodiment. Beside that, the system of the second embodiment is constructed in the same manner with the first embodiment.

The entire structure of the engine to which the present system is applied will be explained at first by using FIG. 12. As shown in the figure, an inlet air pressure sensor 60 is provided on the intake passage 4 of the engine 1 to detect pressure (boost pressure) within the intake passage 4. The turbo-charger 8, provided on the engine 1, is a variable capacity turbo-charger whose boost pressure can be changed by changing an opening angle of a variable nozzle not shown provided on the side of a turbine 8*a* corresponding to the running state of the engine 1. The opening angle of the variable nozzle of the turbine 8*a* is controlled based on the control signal from the controller 10. It is noted that such variable capacity turbo-charger itself is publicly known. Other than that described above, the engine system of the second embodiment is constructed in the same manner with the fuel and water injection engine described in the first embodiment, so that a detailed explanation of the engine 1 itself will be omitted here.

Next, the main structure of the system will be explained with reference to FIG. 10. As shown in the figure, a boost pressure setting map 17 for setting the boost pressure of the turbo-charger 8 is provided in the ECU (controller) 10 additionally to the structure explained in the first embodiment.

While the turbo-charger 8 is constructed to be able to change the boost pressure by changing the opening of the variable nozzle not shown as described above, the boost pressure of the turbo-charger 8 is set by the boost pressure setting map 17 based on the information from the engine speed sensor 30 and the load (the rack position Rw1' of the fuel injection pump 3).

In concrete, the boost pressure (target boost pressure) is set corresponding to the running state of the engine 1 from engine characteristic data (not shown) stored in the boost pressure setting map 17 by taking in the variation of the engine speed obtained from the engine speed sensor 30 and the basic fuel injection amount (the rack position Rw1') as the information on the load of the engine 1. The boost pressure setting map 17 is memorized as a map as shown in FIG. 11E for example.

The variable nozzle is opened to reduce exhaust resistance while effectively utilizing exhaust energy in the high speed range, and the variable nozzle is throttled to turn the turbine 8*a* at high speed even with small exhaust energy in the low speed range for example.

At this time, the inlet air pressure sensor 60 detects the boost pressure in the intake passage 4 and feeds back it to the controller 10. Then, the controller 10 controls, in feedback, the opening of the variable nozzle so that the deviation between the above-mentioned boost pressure (actual boost pressure) and the target boost pressure is eliminated.

Next, the main function of the present embodiment will be explained. The water injection amount is corrected with respect to the characteristic of the water injection amount map 13 based on the both information of the boost pressure set by the boost pressure setting map 17 and the EGR rate set by the EGR system operation control map 15 in the second embodiment.

Figure 11A:
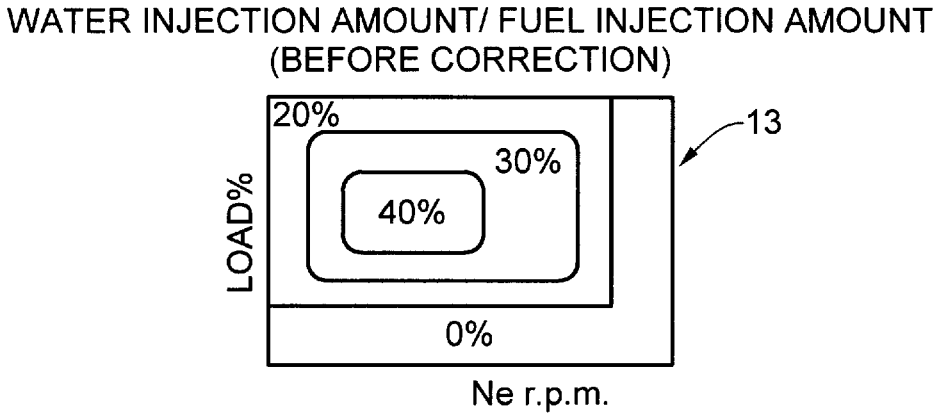
FIGS. 11A through 11E are graphs showing the characteristics of water injection amount, the water injection amount correcting characteristics, the characteristics of EGR rate, and the characteristic of boost pressure in the water injection amount control system for the fuel and water injection engine of the second embodiment.

That is, the water injection amount is decided at first from the engine load (the rack position Rw1') and the engine speed by using the water injection amount map 13 as shown in FIG. 11A. Meanwhile, when the EGR rate is set by using the EGR system operation control map 15 as shown in FIG. 11C, the water injection amount is set (corrected) corresponding to the EGR rate by using the water injection amount correcting map 16 as shown in FIG. 11B.

Figure 11B:
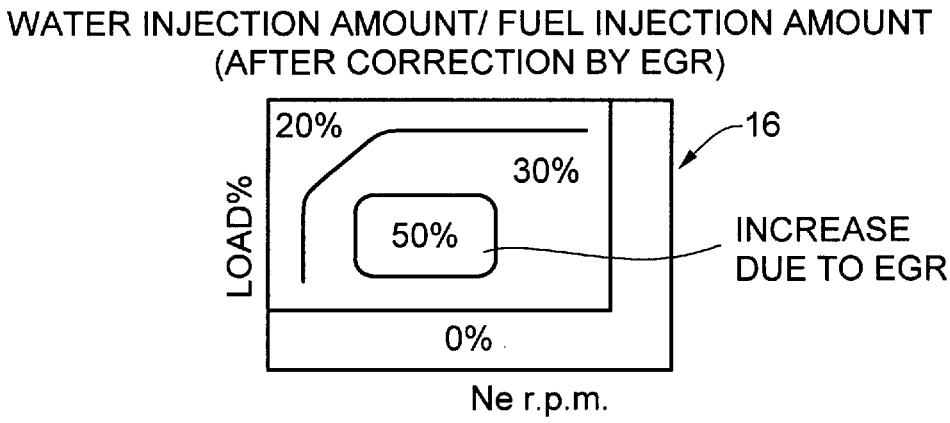
Figure 11C:
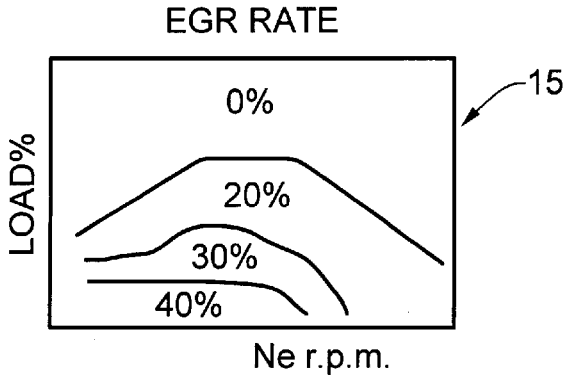

It is noted that the map shown in FIG. 11B is a corrected version of the map shown in FIG. 11A by taking the rise of the inlet air temperature caused by the increase of the EGR rate into account, and is the same with that of the first embodiment described above.

Figure 11D:
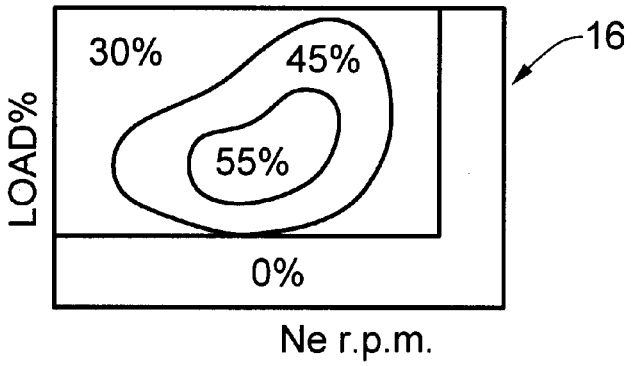
Figure 11E:
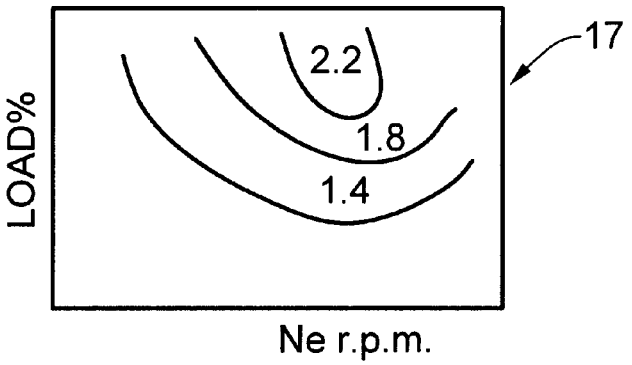

When the boost pressure (target boost pressure) is set by the boost pressure setting map 17 as shown in FIG. 11E, the water injection amount is set (corrected) further by using the water injection amount correcting map 16 as shown in FIG. 11D in the second embodiment.

Here, the map shown in FIG. 11D is a map in which the water injection amount in the map shown in FIG. 11B is corrected corresponding to the change of the boost pressure. The final water injection amount is set based on this map.

For instance, in the water injection amount map shown in FIG. 11D, the water injection amount of the high load side in the middle to high speed range, corresponding to the range in which the boost pressure is 2.2 atmospheric pressure, is increasing from 30% to 45%, and water injection amount, in the middle speed and middle load range, is increasing 50% to 55% by the boost pressure corresponding to the boost pressure setting map 17 shown in FIG. 11E. It is noted that although the ranges in which the water injection amount is 55%, 45% and 30% are shown typically in FIG. 11D, it is needless to say that ranges of 50%, 40% and the like exist between those ranges.

It is noted that the boost pressure setting map 17 functions as boost pressure detecting means for detecting or estimating the boost pressure caused by the turbo-charger 8 because the variable nozzle of the turbo-charger 8 is controlled based on the boost pressure set by the boost pressure setting map 17 in the second embodiment.

Now, the reason why the water injection amount is corrected corresponding to the boost pressure will be explained. The maximum water injection amount fluctuates largely by the boost pressure in the engine fitted with the turbo-charger because the influence of the boost pressure on the combustion is relatively large. However, because the maximum water injection amount has been set without taking the fluctuation of the boost pressure into consideration in the past, there has been a case when the water injection amount is maximized even though there is an enough margin to the actual limit water injection amount depending on the operating state of the turbo-charger. Thereby, there has been a case when the NOx reducing effect cannot be fully obtained.

By the way, there is the characteristic between the boost pressure and the water injection amount that the higher the boost pressure, the more the maximum water injection amount can be. That is, there is a case when a water injection amount which might cause flameout in the state where the boost pressure is low, allows the engine to run fully in the state where the boost pressure is high.

Meanwhile, because the temperature of inlet air rises and the ignitability of fuel injected in the initial period is improved when the EGR rate increases, the water injection amount may be increased as described in the first embodiment. The NOx reducing effect has been enhanced by changing the rack position Rw2 set by the water injection amount map 13 to increase the water injection amount corresponding to the EGR rate from such point of view in the first embodiment, the maximum water injection amount is increasingly corrected by noticing on both of the rise of the inlet air temperature caused by the introduction of EGR gas and the improvement of the limit of combustion caused by the fluctuation of the boost pressure of the turbo-charger 8 in the second embodiment.

Accordingly, because the NOx reducing effect obtained by setting the water injection amount, corresponding to the boost pressure, is added to the NOx reducing effect, obtained by setting the water injection amount corresponding to the operating state of the EGR system when the EGR system is operative, the system of the second embodiment has an advantage that it allows the enhanced NOx reducing effect to be obtained.

Because the water injection amount control system for the fuel and water injection engine of the second embodiment of the present invention is constructed as described above, the information Acc and Ne detected by the accelerator opening sensor 20 and the engine speed sensor 30 are taken into the ECU (controller) 10 at first and the rack position Rw1' of the fuel injection pump 3 is set by the governor map 11 and the full rack map 12 based on such detected information.

Further, the rack position Rw2 of the water supply pump 2 is set by the water injection amount map 13 by taking the rack position Rw1' of the fuel injection pump 3 and the engine speed Ne as parameters.

Meanwhile, the target EGR rate of the EGR system is set by the EGR system operation control map 15 by adding information from the group of other sensors 50 to the information from the engine speed sensor 30, and the opening angle of the EGR valve 7 is controlled so that this target EGR rate is attained.

Further, the target boost pressure of the turbo-charger 8 is set by the boost pressure setting map 17, provided within the controller 10, by adding the information from the inlet air pressure sensor 60 and from the group of other sensors 50 to the information from the engine speed sensor 30, and the opening angle of the variable nozzle, not shown, is controlled in feedback to attain the target boost pressure.

Then, the rack position Rw2 of the water supply pump 2 is corrected by the water injection amount correcting map 16 based on the EGR rate set by the EGR system operation control map 15 and the boost pressure set by the boost pressure setting map 17 in the present system.

Then, the operation of the water supply pump 2 is controlled to set its rack position to the corrected rack position Rw3. The correction is made so that the water injection amount increases corresponding to the increase of the EGR rate and to the increase of the boost pressure in the water injection amount correcting map 16.

It is noted that the water injection amount map (see FIG. 11D) corrected by taking the EGR rate and the boost pressure into account is set as the water injection amount correcting map 16 in the second embodiment. In concrete, the corrected water injection amount is set from the map shown in FIG. 11D based on the engine speed and the load in the water injection amount correcting map 16.

Further, the rack position correction value dRw1 for correcting the decrease of torque caused by the injection of water is set by the torque reduction correcting map 14 based on the rack position Rw3 of the water supply pump 2 set by the water injection amount correcting map 16 and the information Ne detected by the engine speed sensor 30.

Then, this correction value dRw1 is added to the rack position Rw1' of the basic fuel injection amount and thereby, the final rack position Rw1 of the fuel injection pump 3 is set as Rw1'+dRw1. Then, the operation of the fuel injection pump 3 is controlled to set its rack position to that rack position.

By the way, NOx may be reduced further almost without increasing the discharge of HC and smoke as shown in FIGS. 13A through 13C by increasing the water injection amount corresponding to the increase of boost pressure as described above.

All of the horizontal axes of FIGS. 13A through 13C represent the rate of water injection amount to the fuel injection amount and the vertical axes represent the discharges of HC (THC), smoke and NOx, respectively. Lines A through C in each graph indicate the difference of characteristics when the boost pressure is different. More specifically, line A is a line typifying the characteristic when the boost pressure is low, line C is a line typifying the characteristic when the boost pressure is high and line B is a line typifying the characteristic when the boost pressure is middle of them.

As it is apparent from the lines A through C in FIG. 13A, the discharge of NOx has a characteristic that the more the water injection amount, the more NOx decreases. Accordingly, NOx may be reduced considerably by increasing the water injection amount in the range not causing flameout like the present system.

It is also apparent from FIG. 13B that the discharge of smoke decreases with the increase of water injection amount in the range where the water injection amount is relatively small and that it barely changes thereafter even if the water injection amount is increased to a certain amount. Accordingly, smoke will not increase even if the water injection amount (and the maximum water injection amount) is increased with the rise of the boost pressure as described above.

Meanwhile, it is apparent from FIG. 13C that the discharge of HC is small as a whole and its rate of change with respect to the change of water injection amount is small when the boost pressure is high as indicated by the lines A through C.

Here, line L crossing the vertical axis represents the discharge of HC at the maximum water injection amount Wa when the boost pressure is low and a value of permissible limit of HC (limit of THC). Then, it can be seen from the lines B and C that the water injection amounts Wb and Wc reaching the THC limit increase more than Wa when the boost pressure is high.

Then, the discharge of HC may be suppressed within the THC limit without causing flameout by setting the maximum water injection amount within the range of not exceeding the THC limit in increasing the water injection amount (and the maximum water injection amount) with the rise of the boost pressure.

As shown in FIGS. 13A and 13B, the discharge of Nox may be also reduced considerably almost without increasing the discharge of smoke at this time.

Noticing on the EGR system, the inventive system has the advantage that the discharge of NOx may be reduced efficiently by the synergy effect of the NOx reducing effect of the EGR system itself and the NOx reducing effect brought about by the increase of water injection amount as explained in the first embodiment.

The inventive system of the second embodiment has the advantage that the NOx reducing effect may be enhanced further because the NOx reducing effect obtained by setting the water injection amount corresponding to the boost pressure is obtained in addition to the NOx reducing effect obtained by setting the water injection amount corresponding to the operating state of the EGR system.

Next, a modification of the second embodiment of the present invention will be explained. It is noted that only the method for correcting the water injection amount in the water injection amount correcting map 16 is different in this modification and others are almost the same with those in the second embodiment described above. Accordingly, only the method for correcting the water injection amount in the water injection amount correcting map 16 will be explained below and an explanation of the others will be omitted.

According to this modification, when the rack position Rw2 of the water supply pump 2 is decided by the water injection amount map 13, the control signal from the EGR system operation control map 15 and the information detected by the inlet air pressure sensor 60 are taken into the water injection amount correcting map 16 to set correction factors k and m (k, m>0) for correcting the water injection amount based on the EGR rate set by the EGR system operation control map 15 and the boost pressure detected by the inlet air pressure sensor 60. That is, the boost pressure sensor 60 functions as boost pressure detecting means in this modification.

Here, the water injection amount correcting map 16 has a map for setting the correction factor k as shown in FIG. 9 and a map for setting the correction factor m as shown in FIG. 14. Among them, the correction factor k is set in the same manner with that explained in the modification of the first embodiment described above.

The map shown in FIG. 14 is a map for setting the correction factor m of the water injection amount by taking the actual boost pressure of the turbo-charger 8 as a parameter and is set to have a characteristic that the correction factor m increases with the rise of the boost pressure when the boost pressure is set between a first predetermined value b1 and a second predetermined value b2. It is noted that the correction factor m is set at 0 when the boost pressure is less than the first predetermined value b1. That is, substantially no correction is made in this case. When the boost pressure exceeds the second predetermined value b2, the correction factor m is fixed to the maximum m max.

When the correction factors k and m are set by the water injection amount correcting map 16, the rack position Rw2, set by the water injection amount map 13, is corrected by the following expression. That is, the rack position Rw3 of the water supply pump 2 after the correction is set as Rw3=(1+k+m).Rw2. That is, 1 is added to the factors k and m and the resultant value is multiplied with the rack position Rw2 to output as the rack position of the water supply pump 2.

Accordingly, when the correction factor k=0.2 and m=0.2 for example, a value obtained by multiplying the rack position Rw2, set by the water injection amount map 13, by 1.4 is outputted as the rack position Rw3 of the water supply pump 2.

It is noted that although the correction factor m is set to increase at a constant rate with the rise of the boost pressure when the boost pressure is set within the range between the first predetermined value b1 and the second predetermined value b2 in FIG. 14, the characteristic of the correction factor m is not limited to such. Further, the correction factor setting range and the expression for correcting the rack position are not limited to those described above.

Still more, although the inlet air pressure sensor 60 has been used as the boost pressure detecting means in the modification, the correction factors k and m may be found based on the boost pressure set by the boost pressure setting map 17 like the second embodiment described above.

Then, NOx may be reduced further because the NOx reducing effect obtained by setting the water injection amount corresponding to the boost pressure is obtained additionally to the NOx reducing effect obtained by setting the water injection amount corresponding to the operating state of the EGR system even by the modification of the second embodiment in the same manner with the second embodiment described above.

(c) Others:

The inventive water injection amount control system for the fuel and water injection engine is not limited to those of the first and second embodiments described above and is modified in various ways within the scope of the spirit of the present invention. For instance, although the water injection amount correcting map 16 is provided as the map (see FIG. 2B) for setting the water injection amount anew by taking the EGR rate into account in the first embodiment, the water injection amount correcting map 16 may be provided as a map for setting only the correction amount of the water injection amount so as to add the correction amount set by the water injection amount correcting map 16 to the water injection amount set by the water injection amount map 13.

Further, although the water injection amount is changed by taking the EGR rate of the EGR system as the parameter in the first and second embodiments, the water injection amount may be changed by taking the EGR amount itself as a parameter. In this case, a sensor for detecting a flow rate of the recirculating exhaust gas is provided on the EGR passage 4 as the EGR amount detecting means to correct the water injection amount based on information from this sensor. In this case, the system may be arranged so that the water injection amount increases with the increase of the EGR amount for example.

An inlet air temperature sensor may be provided as the EGR amount detecting means within the sensor group 50 to correct the water injection amount based on information on inlet air temperature detected by this sensor. It is because the inlet air temperature changes corresponding to the EGR amount (or the EGR rate) when the EGR system is operative.

A sensor for detecting the opening angle of the EGR valve 7 may be also added as the EGR amount detecting means within the sensor group 50 to correct the water injection amount by using information detected by this sensor.

Still more, means for estimating the EGR amount (or the EGR rate) based on the information from the sensor group 50 may be provided as the EGR amount detecting means to correct the water injection amount based on the EGR amount (or the EGR rate) estimated by this EGR amount detecting means.

The super-charger is not limited to the variable capacity turbo-charger 8 described above and various super-chargers may be used in the second embodiment. The inter-cooler 9 is not an essential component of the present invention, so that it may be omitted.

Further, although the water injection amount correcting map 16 is provided as the map (see FIG. 11D) for setting the water injection amount by taking the EGR rate and the boost pressure into account in the second embodiment, it is possible to arrange to set the water injection amount correction amount separately based on the EGR rate after setting the water injection amount based on the basic fuel injection amount and to set the water injection amount correction amount again separately from the boost pressure.

It is also possible to arrange to provide a sensor for directly detecting the opening angle of the variable nozzle which changes the capacity of the turbine of the turbo-charger 8 to detect the boost pressure by taking the opening angle of the variable nozzle, the engine speed and the load as parameters when the variable capacity turbo-charger 8 is used like the second embodiment.

Still more, it is possible to set means for estimating or calculating the boost pressure created by the super-charger as boost pressure detecting means. For example, estimating means (or computing means) for estimating the boost pressure may be provided within the controller 10 to estimate the boost pressure from the operating state of the super-charger.

As described above, many modifications and variations of the present invention are possible obviously in the light of the above teachings. The scope of the invention, therefore, is to be determined solely by the following claims.

What is claimed is:

1. A water injection amount control system for a fuel and water injection engine, comprising:

running state detecting means for detecting running state of said engine;

an EGR system for recirculating part of exhaust gas of said engine to a combustion chamber of said engine;

EGR system operating state detecting means for detecting or estimating the operating state of said EGR system;

water injection amount regulating means for regulating an amount of water to be injected to said combustion chamber of said engine;

water injection amount setting means for setting a water injection amount based on information from said running state detecting means and said EGR system operating state detecting means; and control means for controlling the operation of said water injection amount regulating means based on the set water injection amount.

2. The water injection amount control system for the fuel and water injection engine according to claim 1, wherein said water injection amount setting means includes basic water injection amount setting means for setting a basic water injection amount based on information from said running state detecting means and corrects the set basic water injection amount based on the information from said EGR system operating state detecting means.

3. The water injection amount control system for the fuel and water injection engine according to claim 1, further comprising:

fuel injection amount regulating means for regulating an injection amount of fuel to be injected to said combustion chamber;

fuel injection amount setting means for setting a basic fuel injection amount based on information from said running state detecting means; and fuel injection amount correcting means for correcting said set basic fuel injection amount based on said set water injection amount.

4. The water injection amount control system for the fuel and water injection engine according to claim 1, further comprising:

a fuel and water injection nozzle adapted to inject fuel and water in stratification in order of fuel, water, and fuel from one and same injection hole in one time of injection.

5. The water injection amount control system for the fuel and water injection engine according to claim 4, wherein said fuel and water injection nozzle includes, a nozzle body, an injection port provided at the edge portion of said nozzle body, a needle slidably fitted within said nozzle body and urged in the direction of closing said injection port, a fuel reservoir facing said needle within said nozzle body, a fuel passage provided within said nozzle body and communicating with said fuel injection amount regulating means by extending to the upstream side of said fuel reservoir, and a water passage provided within said nozzle body and communicating said fuel passage at the upstream side of said fuel reservoir with said water injection amount regulating means.

6. The water injection amount control system for the fuel and water injection engine according to claim 1, wherein said EGR system operating state detecting means detects or estimates the operating state based on an output of a temperature sensor provided at the downstream side of an exhaust gas inlet port in an induction system.

7. The water injection amount control system for the fuel and water injection engine according to claim 1, wherein said EGR system operating state detecting means detects or estimates the operating state based on a valve opening of an exhaust gas recirculating valve for regulating an amount of recirculated exhaust gas in said EGR system.

8. The water injection amount control system for the fuel and water injection engine according to claim 1, further comprising:

fuel injection amount regulating means for regulating an injection amount of fuel to be injected into said combustion chamber;

fuel injection amount setting means for setting control parameter values related to the fuel injection amount based on the opening of an accelerator pedal and the engine speed detected by said running state detecting means; and EGR setting means for setting one of an EGR amount and an EGR rate based on engine speed detected by said running state detecting means and the set control parameter values;

said water injection amount setting means including basic water injection amount setting means for setting a basic water injection amount based on information from said running state detecting means, and correcting the basic water injection amount decided by said basic water injection amount setting means based on the EGR amount or the EGR rate decided by said EGR setting means.

* * * * *